United States Patent [19]

Vadakin

[11] Patent Number: 4,945,862

[45] Date of Patent: Aug. 7, 1990

[54] TWO DIMENSIONAL SHUTTLE ROTARY CLEANING DEVICE

[75] Inventor: Thomas C. Vadakin, Marietta, Ohio

[73] Assignee: Vadakin, Inc., Marietta, Ohio

[21] Appl. No.: 451,776

[22] Filed: Dec. 18, 1989

[51] Int. Cl.[5] ..... F28G 3/16

[52] U.S. Cl. ..... 122/392; 15/316.1; 122/382; 134/181

[58] Field of Search ..... 134/172, 180, 181; 122/379, 382, 390, 391, 392; 15/316 R, 316 A, 317, 318; 239/DIG. 13

[56] References Cited

U.S. PATENT DOCUMENTS

| | | | |
|---|---|---|---|
| 1,971,020 | 8/1934 | Snow | 122/392 |
| 2,358,358 | 9/1944 | Stromquist | 122/342 X |
| 3,903,912 | 9/1975 | Ice, Jr. et al. | 15/317 X |
| 4,333,742 | 6/1982 | Tanca | 122/390 X |
| 4,421,067 | 12/1983 | Krowech | 122/390 |
| 4,565,206 | 1/1986 | Booij | 122/391 X |
| 4,646,768 | 3/1987 | Tanaka et al. | 134/172 X |
| 4,690,159 | 9/1987 | Vadakin et al. | 134/172 X |
| 4,715,324 | 12/1987 | Muller et al. | 122/382 X |

FOREIGN PATENT DOCUMENTS

| | | | |
|---|---|---|---|
| 2162499 | 1/1978 | Fed. Rep. of Germany | 122/390 |
| 0962746 | 9/1982 | U.S.S.R. | 15/316 R |

*Primary Examiner*—Philip R. Coe

*Attorney, Agent, or Firm*—Laubscher, Presta & Laubscher

[57] ABSTRACT

An improved two-dimensional shuttle rotary cleaning device includes a frame with which is connected a bracket adapted for pivotal movement between first and second positions normal and parallel to the frame, respectively. A cleaning assembly is slidably connected with the bracket for cleaning the exterior surfaces of pendant tubes of a boiler. The cleaning assembly includes a tubular lance and a rotary union connecting the lance with the bracket and rotating the lance about its axis. An air cylinder is connected with the cleaning assembly for reciprocating the assembly relative to the bracket along the axis of the lance. Pressurized cleaning fluid is supplied to the lance via the rotary union. The fluid exits the lance via the plurality of radial openings, whereby the cleaning fluid is directed under pressure against the surfaces of the pendant tubes to remove slag and other built up materials therefrom. When the pivotal bracket is in the first position, the lance is arranged between and normal to the pendant tubes for cleaning the exterior surfaces thereof when the rotary union and air cylinder are operated. When the bracket is pivoted to the second position, the lance is swung from between the pendant tubes to a position parallel to the tubes so that the frame may be moved to a position adjacent the next row of tubes for cleaning.

7 Claims, 2 Drawing Sheets

TWO DIMENSIONAL SHUTTLE ROTARY CLEANING DEVICE

BACKGROUND OF THE INVENTION

Large commercial coal fired boilers comprise vertical and horizontal sections of pendant tubes. Over time, slag deposits build up on the exterior surfaces of the tubes and eventually plug the backspace areas between these tubes. The vertical and horizontal pendant sections are so fabricated that impingement upon the waste materials accumulating on and between the tube surfaces is very difficult. Cleaning of these surfaces has normally been accomplished using a hand held lance which directs cleaning fluid for impingement upon only the accessible portions of the total surface.

The present invention relates to a device for effectively cleaning slag deposits from the exterior surface of all sections of pendant tubes of a large boiler. It may also be used to remove wastes deposited in electrostatic precipitators.

BRIEF DESCRIPTION OF THE PRIOR ART

Various devices for cleaning sludge from boiler tubes are well-known in the patented prior art as evidenced for example by the patent to Mueller et al U.S. Pat. No. 4,715,324 which discloses a high pressure water lance which is oscillated and moved incrementally inwardly along the central tube lance of a nuclear steam generator to dislodge sludge from the tube plate and heat exchange tubes.

Also known in the art are rotary cleaning devices such as that disclosed in the Vadakin et al U.S. Pat. No. 4,690,159 which is owned by the owner of the present invention. The Vadakin et al device includes a swivel mechanism which rotates about and travels along a shaft. A pair of lances are connected with the swivel and serve to direct a high pressure flow of water against the interior surface of a cylindrical housing for cleaning the same.

While the prior devices normally operate satisfactorily, they are limited in their suitability for use in cleaning the backspace areas of pendant tubes. The present invention was developed in order to improve upon the prior art by providing a true two-dimensional cleaning device which may be used for cleaning both horizontal and vertical sections of pendant tubes and which is adapted to reach and clean the areas of the boiler which are not accessible by the prior devices.

SUMMARY OF THE INVENTION

Accordingly, it is primary object of the present invention to provide a device for cleaning spaced parallel rows of pendant tubes of steam boilers and the like including a frame arranged parallel to the pendant tubes and a bracket connected with the frame for pivotal movement between first and second positions normal and parallel to the frame, respectively. A cleaning mechanism is slidably connected with the bracket for cleaning the exterior surfaces of the pendant tubes. The cleaning mechanism includes a tubular lance and a rotary device connecting the lance with the bracket and for rotating the lance about its axis. Finally, a reciprocating drive mechanism is connected between the bracket and the cleaning device for reciprocating the cleaning device along the axis of the lance relative to the bracket. When the bracket is in the first position, the lance extends between and normal to the pendant tubes for cleaning the exterior surfaces thereof when the rotary and reciprocating devices are operated. When the bracket is pivoted to the second position, the lance is swung from between the pendant tubes to a position parallel thereto so that the frame may be moved to a position adjacent the next row of tubes for cleaning.

The rotary device comprises a rotary union connected with the lance and an air driven gear mechanism for rotating the rotary union at a given speed. Furthermore, the reciprocating device comprises a cylinder connected with the bracket and a piston connected with the rotary device. The cylinder is also driven by compressed air.

According to a preferred embodiment of the invention, the lance contains a plurality of spaced radial openings, and a source of pressurized cleaning fluid such as water is connected with the cleaning device for supplying cleaning fluid under pressure to the interior of the lance. Pressurized cleaning fluid is directed from the lance via the spaced radial openings and impinges on the adjacent pendant tube surfaces to remove slag deposits therefrom.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 2:
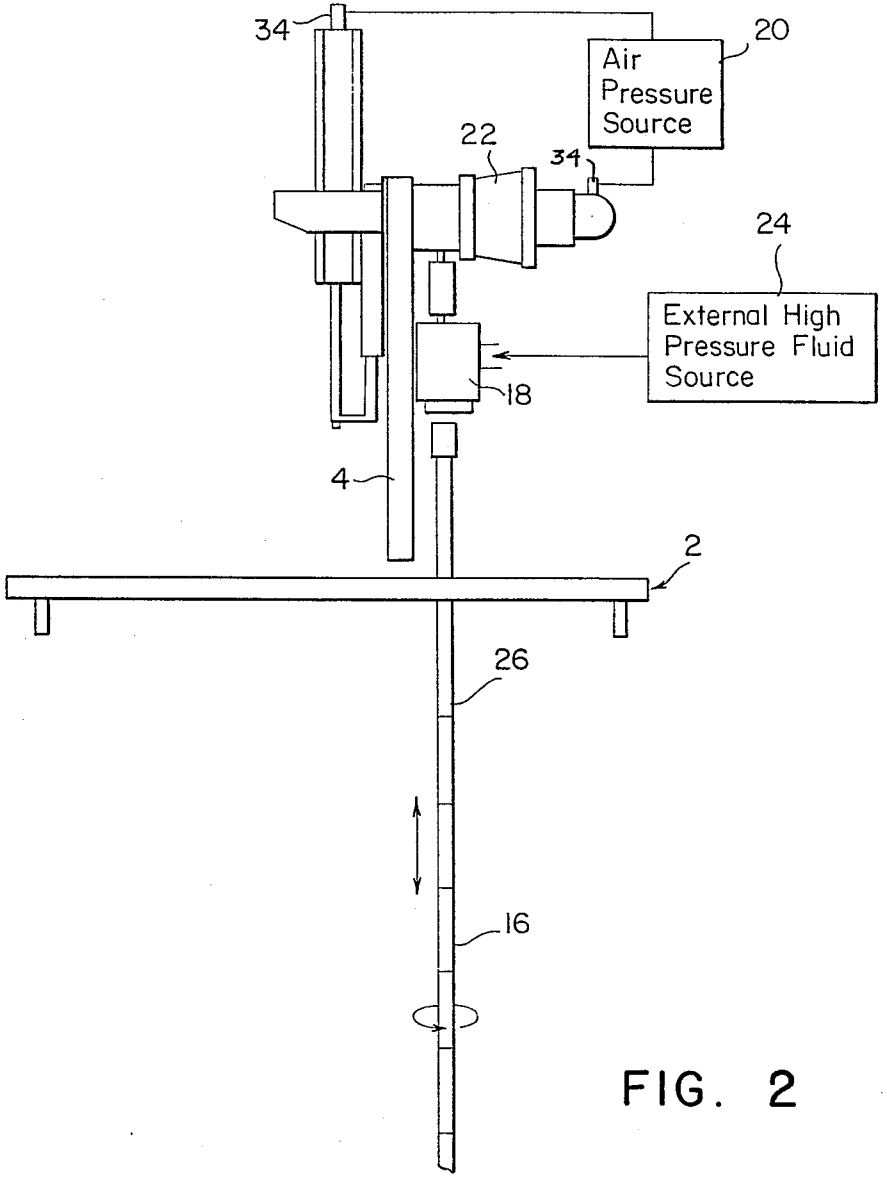
FIG. 2 is a side plan view of the cleaning device of FIG. 1 in its assembled condition connected with the support frame.
Figure 1:
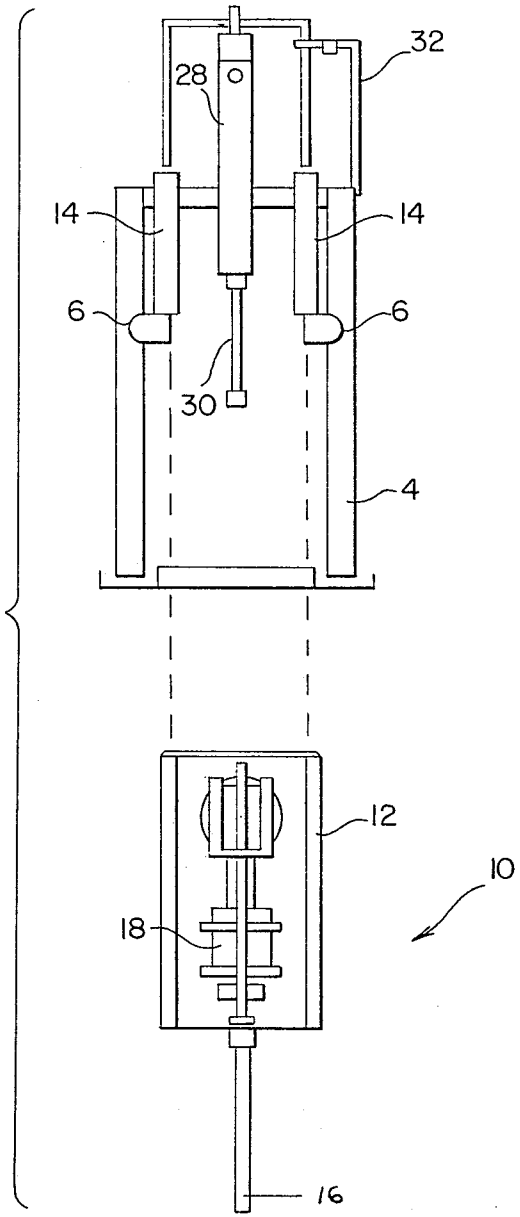
FIG. 1 is an exploded front plan view of the two dimensional rotary cleaning device according to the invention.

Referring first to FIGS. 1 and 2, the two-dimensional rotary cleaning device according to the invention will be described.

The device includes a frame 2 which is adapted for parallel arrangement relative to the pendant tubes of the steam boiler to be cleaned as will be developed in greater detail below. Connected with the frame 2 is a stand pipe 4 which is arranged normal to the plane containing the frame 2. Pivotally connected with the stand pipe 4 is a pivoting bracket 6. The bracket 6 is adapted for pivotal movement between first and second positions normal and parallel to the frame, respectively.

Figure 4:
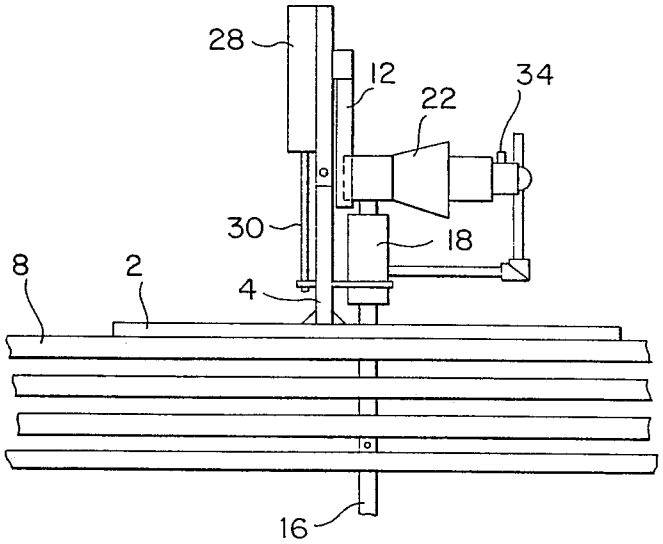
FIG. 4 is a partial plan view of the cleaning device according to the invention arranged for cleaning horizontal pendant tubes.
Figure 3:
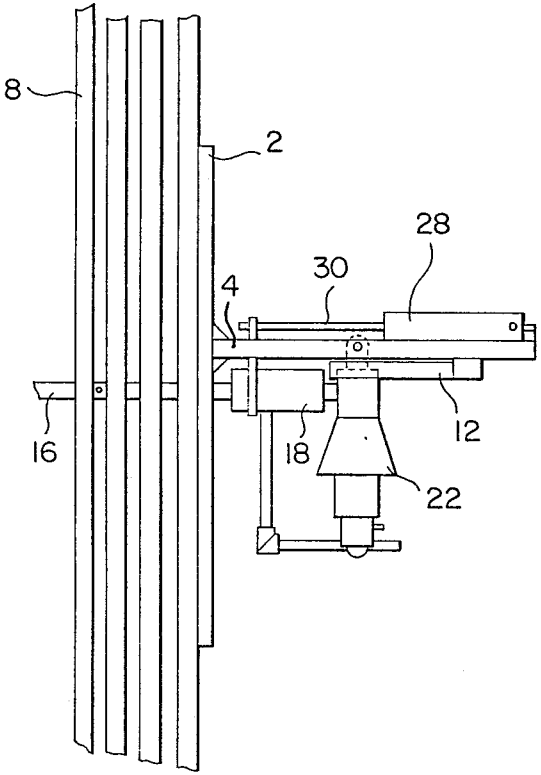
FIG. 3 is a partial plan view of the rotary cleaning device of FIG. 2 arranged for cleaning vertical pendant tubes.

As shown in FIG. 3, a plurality of pendant tubes 8 are arranged in spaced parallel relation. The tubes of FIG. 3 have a vertical axis. The frame 2 of the rotary cleaning device is mounted against one of the pendant tubes 8 and in parallel relation thereto. For example, the frame 2 can be suspended from the ceiling for arrangement adjacent the parallel pendant tubes. In the embodiment of FIG. 4, horizontal pendant tubes 8 are shown, with the frame 2 of the rotary cleaning device resting thereon.

Referring once again to FIG. 1, there is shown the cleaning assembly 10 which is adapted for connection with the pivoting bracket 6. More particularly, the cleaning assembly 10 includes the pair of slide brackets 12 which cooperate with fixtures 14 connected with the pivotal bracket 6, whereby the cleaning assembly 10 may be slidably connected with the pivoting bracket. The cleaning assembly 10 includes a tubular lance 16 and a rotary union device 18 driven off an air pressure source 20 via a gear mechanism 22 to rotate the lance about its axis. An external high pressure fluid source 24 is connected with the rotary union 18 for supplying a pressurized cleaning fluid such as water to the interior of the lance. In order to direct the cleaning fluid against the exterior surfaces of the pendants to be cleaned, the lance contains a plurality of spaced radial openings 26 which are preferably arranged in pairs on opposite sides of the lance to neutralize backthrust.

Also connected with the pivotal bracket 6 is a cylinder 28 and piston 30 assembly. The cylinder 28 is preferably an air cylinder and is connected with the air pressure source 20 to control the displacement of the piston 30. The piston is connected with the slide brackets 12 of the cleaning assembly to reciprocate the cleaning assembly relative to the frame under control of the air pressure source. As shown in FIG. 2, the reciprocal movement of the cleaning assembly is along the axis of the lance 16.

When the bracket is in the first position normal to the frame 2 as shown in for example in FIG. 2, the lance extends between and normal to the pendant tubes, as shown in FIGS. 3 and 4, for cleaning the exterior surfaces of the tubes when the rotary union 18 and the air cylinder 28 are operated by the air pressure source. This displacement of the lance serves to direct cleaning fluid across a large area of the pendant tubes and the high pressure fluid impinges upon the slag to dislodge it from the exterior surfaces of the pendant tubes. When the bracket is pivoted toward its second position, the lance is swung from between the pendant tubes to a position parallel to the tubes and the frame so that the frame may be moved laterally to a position adjacent the next row of tubes for cleaning a new backspace section of the tubes by pivoting the bracket to its first position and operating the rotary union 18 and air cylinder 28.

In order to lock the pivoting bracket 6 into either its first or second positions, a locking bracket 32 is provided which is connected with the stand pipe 4. In operation, compressed air is introduced to the air motors on the geared rotary union and into the air cylinder from the air pressure source via volume regulators 34 connected with the rotary union gear mechanism 22 and the air cylinder, respectively. The air regulators independently control the speed of operation of the air cylinder 28 and the rotary gear mechanism 22 to control the speed of rotation of the lance as well as the speed of reciprocation of the lance for maximum delivery of cleaning fluid to pendant sections. Water at high pressure is introduced into the rotary union from the external high pressure fluid source 24. The multiple openings provided in the lance are preferably of variable sizes. These openings are placed diametrically opposite each other to neutralize back thrust from the pressurized cleaning fluid exiting the lance. The entire cleaning apparatus is activated by an electrical system which independently controls the pressurized fluid and air pressure sources. The device is raised and lowered relative to vertical pendant tubes (FIG. 3) or drawn horizontally relative to horizontal pendant tubes (FIG. 4) by any suitable manually operated means such as, for example, a winch. Thus the cleaning device can be moved from section to section within the steam boiler to effectively clean all interior backspace sections of the pendant tubes.

The present invention improves accessibility to the entire pendant tube section surface to be cleaned, provides more efficient cleaning in less time, and affords a safe working environment since workmen need no longer enter the pendant tube sections for manual cleaning.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. Apparatus for cleaning spaced parallel rows of pendant tubes in boilers, comprising (a) a frame arranged parallel to the pendant tubes;

(b) a bracket connected with said frame for pivotal movement between first and second positions normal and parallel to said frame, respectively;

(c) cleaning means slidably connected with said bracket for cleaning the exterior surfaces of the pendant tubes, said cleaning means including (1) a tubular lance; and (2) rotary means connecting said lance with said bracket and for rotating said lance about its axis; and (d) means for reciprocating said cleaning means relative to said bracket along the axis of said lance, whereby when said bracket is in said first position, said lance extends between and normal to the pendant tubes for cleaning the exterior surfaces thereof when said rotary and reciprocating means are operated, and when said bracket is pivoted to said second position, said lance is swung from between the pendant tubes to a position parallel thereto so that the frame may be moved to a position adjacent the next row of tubes for cleaning.

2. Apparatus as defined in claim 1, wherein said rotary means comprises (1) a rotary union connected with said lance; and (2) an air-driven gear mechanism for rotating said rotary union at a given speed.

3. Apparatus as defined in claim 2, wherein said reciprocating means comprises a cylinder connected with said bracket and a piston connected with said rotary means.

4. Apparatus as defined in claim 3, and further comprising means connected with said bracket for locking said bracket into one of its first and second positions.

5. Apparatus as defined in claim 4, wherein said lance contains a plurality of spaced radial openings and further comprising means for delivering a pressurized cleaning fluid to said lance via said rotary union, whereby the cleaning fluid exits said lance via said openings and impinges on the adjacent pendant tube surfaces to remove slag deposits therefrom.

6. Apparatus as defined in claim 5, wherein said cleaning fluid comprises water.

7. Apparatus as defined in claim 5, wherein said openings are arranged in pairs on opposite sides of said lance.

* * * * *